US006319094B1

(12) United States Patent
Williams

(10) Patent No.: US 6,319,094 B1
(45) Date of Patent: Nov. 20, 2001

(54) METHOD AND APPARATUS FOR CONTROLLING ABRASIVE FLOW MACHINING

(75) Inventor: Robert E. Williams, Lincoln, NE (US)

(73) Assignee: Extrude Home Corporation, Irwin, PA (US)

( * ) Notice: Subject to any disclaimer, the term of this patent is extended or adjusted under 35 U.S.C. 154(b) by 0 days.

(21) Appl. No.: 09/474,237

(22) Filed: Dec. 29, 1999

(51) Int. Cl.[7] ..... B24B 49/00
(52) U.S. Cl. ..... 451/8; 451/36
(58) Field of Search ..... 451/8, 1, 36, 61, 451/64; 73/681.18, 681.21, 681.356

(56) References Cited

U.S. PATENT DOCUMENTS

| | | | | |
|---|---|---|---|---|
| 3,521,412 | * | 7/1970 | McCarty | 51/317 |
| 3,634,973 | * | 1/1972 | McCarty | 51/2 R |
| 3,819,343 | * | 6/1974 | Rhoades | 51/302 |
| 5,125,191 | * | 6/1992 | Rhoades | 51/317 |
| 5,245,794 | | 9/1993 | Salugsugan . | |
| 5,714,687 | | 2/1998 | Dunegan . | |
| 5,807,163 | | 9/1998 | Perry . | |
| 5,929,315 | | 7/1999 | Dunegan . | |
| 6,041,656 | * | 3/2000 | Dunegan | 73/587 |

OTHER PUBLICATIONS

Transaction of the ASME, vol. 106, Feb. 1984 titled "An Investigation of Grinding and Wheel Loading Using Acoustic Emission" by D. Dornfeld and He Gao Cai, pp. 28–33.
Publication titled "Robotic Deburring With Real Time Acoustic Feedback Control" by D. A. Dornfeld and E. Erickson, pp. 13–26.
Internet Publication from www.deci.com/AESmart.html titled "Get Smart get the AESMART 2000" printed Nov. 12, 1999, 6 pages.
Internet Publication from www.deci.com titled "Modal Anaysis of Acoustic Emission Signals" dated Oct. 1997 by H.L. Dunegan, 14 pages.
DECI Newsletter and Reports publication titled "An Acoustic Emission Technique for Measuring Surface Roughness" dated Dec. 1998 by H.L. Dunegan, 10 pages.
Computers in Industry publication titled "Application of Intelligent CNC in grinding" dated 1996 by W. Brian Rowe et al., pp. 45–60.
DECI Newsletter and Reports publication titled "Acoustic Emission Monitering Of Fatigue Crack Growth In Bridges" dated Nov. 1998, by H.L. Dunegan, 4 pages.
ASME Journal of Manufacturing Science and Engineering publication titled "Acoustic Emission Characteristics of Abrasive Flow Machining" dated 1998 by R.E. Williams, vol. 120, pp. 264–271.
PCT International Search Report for International Application Number PCT/US 00/35463.

* cited by examiner

*Primary Examiner*—Timothy V. Eley
*Assistant Examiner*—Dung Van Nguyen
(74) *Attorney, Agent, or Firm*—Webb Ziesenheim Logsdon Orkin & Hanson, P.C.

(57) ABSTRACT

A method for controlling the abrasive machining, especially abrasive flow machining of a part which includes measuring any acoustic emission signal caused by the abrasive machining of such part; thereafter comparing a high frequency, e.g. greater than 100 kHz, component of said signal with a low frequency, e.g. less than 100 kHz, component of said signal to generate a control ratio. When the control ratio reaches a predetermined ratio, or predetermined change in the ratio over time, a control action of the machining process is effected, such as termination of the flow of abrasive.

13 Claims, 5 Drawing Sheets

METHOD AND APPARATUS FOR CONTROLLING ABRASIVE FLOW MACHINING

FIELD OF THE INVENTION

The present invention relates a method and apparatus for controlling machining by abrasive flow using viscoelastic medium and in particular to a method utilizing acoustic emissions created by the flow of the abrasive medium.

BACKGROUND OF THE INVENTION

Abrasive Flow Machining (AFM) has gained wide acceptance for a number of applications as the machining and finishing technique of choice. Such techniques are particularly well adapted, for example, to working interior passages in work pieces, for light grinding, deburring, radiussing, leveling, and polishing of complex surfaces, and particularly three-dimensioned surfaces where surface detail requires working, and in repetitive working of multiple work pieces of complex form and shape.

In certain applications, abrasive flow machining involves passing a viscoelastic medium containing an abrasive through orifices that require substantial uniformity through or across the surfaces to be worked. The viscoelastic medium functioning as a carrier for the abrasive also provides the working force to the abrasive as the abrasive is forced through an orifice or carried across the surface. The medium flows to conform to the opening or surface of the work piece. Thus, one of the advantages of the process is to fill passages and span work surfaces when placed between a work piece surface and a member designed to confine the flow and constrain the medium in engagement with the surface of the work piece.

In many contexts, particular advantages are attained when the viscoelastic abrasive medium is also rheopectic, i.e., increasing in apparent viscosity with applied stress. With the appropriate application of stress, typically either shear or compressive stress, to the medium, it is possible to substantially attain plug flow of the medium across the surfaces of the work piece to be worked in the operation. Substantially higher working force is applied to the surface by such plug flow when compared to viscous flow of the medium. A description of the basic prior art on abrasive flow machining can be found in U.S. Pat. Nos. 3,521,412, 3,634,973, McCarty and 3,819,343, 5,125,191, Rhoades.

In the use of abrasive flow machining to provide the simultaneous precision machining of parts which are initially manufactured with variations outside of desired tolerances, it is difficult to regulate the flow of media through the parts, because the process is based upon fluid or plastic flow of the medium through a restricted opening or passage in the work piece such as an opening or orifice. Examples of these workpieces include turbine blades, cast intake manifolds, extrusion dies, diesel injector nozzles, and the like. Since the work being done is internal, it is difficult to know when the processing has been completed to exact specifications. In addition, the abrasive flow machining of these complex internal passages is often complicated by the number of dynamic variables involved in the process, including the condition of the abrasive medium, grit sizes, temperatures, extrusion pressures and the volume of media extruded. Because of the interrelationship of the various factors, it is often impossible to determine when a part in process has attained the desires performance criteria. In such cases it is necessary to profile a known functional fluid flow through the parts to determine by repeated tests whether or not the processing has been completed. This uncertainty can lead to the expenditure of unnecessary effort; either in needing to re-process a component to achieve the desired specifications or in the over-processing of components beyond what is required.

It has been shown that there is a correlation between the root mean square (RMS) of the voltage signal of acoustic emission and non-abrasive flow machining conditions found in abrasive machining processes such as grinding or mechanical abrasive deburring, see, e.g., Dornfeld, D. A, and H.G.Cai, 1984, "An investigation of Grinding and Wheel Loading Using Acoustic Emission," *ASME Journal of engineering for Industry*, Vol. 106. pp.28–33; Dornfeld, D. A. and Erickson, E., 1989, "Robotic Deburring With Real Time Acoustic Feedback Control," Mechanics of Deburring and Surface Finishing Processes, PED, Vol. 38, Eds. Stango, R. J. and Fitzpatrick, P. R., ASME, New York, pp. 13–26; Dunegan, H. L. 1999, "Modal Analysis of Acoustic Emission Signals," *Journal of Acoustic Emissions*, Vol. 15, 1–4.

In addition to RMS investigations, other traditional acoustic emission characteristics such as zero crossing rate, rise time, pulse width and Kurtosis have been studied. The analysis of traditional acoustic emission techniques to abrasive flow machining has been described. It is known that the amount of material removed from a part is related to an improvement in surface finish. A correlation has been sought between the acoustic energy ($RMS^2$ of the signal) and the depth of cut and, thus, a correlation with enhancements in the surface finish. The relationship, $RMS=(C*Ac*V)^{1/2}$, where C is a constant depending upon machining conditions and material, V is the media velocity and Ac is the cross sectional area of an extrusion passage, is sensitive to extrusion pressure and other abrasive process parameters which effect material removal. The RMS relationship was found to be an effective correlation for volumetric flow rate of media and the orifice diameter of various parts, however the specific effects of material removal and flow rate are confounded in the RMS equation states above.

While the RMS of acoustic emissions stated above were found to correlate reasonably well with surface finish and material removal, RMS did not correlate with the complex fluid flow profiles used to determine abrasive flow machining processing completeness, especially in complex passages and geometries of flow. Accordingly, it is an object of the invention to provide method and apparatus to use acoustic emission signals to control abrasive flow machining processes. It is another object of the invention to provide a method which is effective and reliable for controlling abrasive flow machines. It is also an objective of the present invention to provide a consistent method for separating acoustic emission signal into various components to establish media flow rates and material removal.

SUMMARY OF THE INVENTION

Low frequency components in the acoustic emission signal relate to material removal and reduction of surface roughness, while the high frequency components are associated with higher media flow rates. While the ratio between the two components is normally illustrative of process progress, in certain applications; e.g., radiusing, material removal is the prime concern and the LF signal is employed to effect process control. The ratio may be used to achieve a desired material removal or a particular media flow rate. The use of the ratio to control the abrasive machining process may be based upon the occurrence of a single ratio or the change of the ratio over time. The ratio at which control of the process occurs, or the media flow is discontinued for a given part or passage, will depend upon the characteristics of the viscoelastic media, e.g., grit size; the material of the part, e.g. aluminum or steel or other metal; and the pressures used by the abrasive flow machine. The number at which flow is discontinued and another part machined, will depend upon the characteristics of viscoelastic media, e.g. grit size, the material of the part, e.g. aluminum or steel or other metal, and the pressures used by the abrasive flow machine.

In general, sources of acoustic emission are both in-plane (IP) and out-of-plane (OOP). Noise sources such as impact and friction are OOP and most of the energy is carried away from the source by $a_o$, a low frequency, for example, less than 100 kHz, flexure wave and high frequency, typically greater than 100 kHz, shear waves. Crack growth is an IP source and most of the energy is carried away from the source by $S_o$, a high frequency (greater than 100 kHz) extensional wave, and high frequency (greater than 100 kHz) shear waves. For the case where the surface of a plate is being abraded, both $S_h$ (horizontal or parallel to the surface), and $S_v$ (vertical or perpendicular to the surface) high frequency shear waves are generated. It has been shown that the $S_v$ waves mode convert into low frequency flexure waves in plates, while the $S_h$ waves maintain their high frequency content without mode conversion. A higher percentage of $S_v$ waves are generated with rougher workpiece surfaces.

During the abrasive flow process, both entrance flow and fully developed or steady state flow situations exist. In entrance flow, the dominant mode is extensional flow, where the principal strain directions are parallel and normal to the surface. A sudden release of strain energy in the parallel direction will result the generation of shear waves, while a sudden release of strain energy in the normal direction will result in a low frequency flexure wave ($a_o$).Depending on the amount of material removal during the entrance flow, low frequency flexure waves ($a_o$) will be generated in addition to high frequency shear waves. In the fully developed or steady region, the media flow is dominated by a simple shear straining. This produces predominately $S_h$ and $S_v$ high frequency shear waves.

Thus, during the start of the machining process when the starting workpiece surface is "rough", the main source of acoustic emission is a low frequency flexure wave. This corresponds to higher material removal and surface roughness improvement. As the surface becomes smoother and typical abrasive flow machining flow lines are established, the main source of emissions becomes higher frequency shear waves. This is associated with a high media flow rate or less flow resistance of the workpiece surface, with other factors constant. Accordingly, the method of the present invention measures the high frequency shear waves and low frequency flexure wave components of the acoustic signal during the processing. While this method is particularly advantageous for abrasive flow machining, it can be used in other such processes which provide components of emission signals. Other advantages of the present invention, therefore, will become apparent from a perusal of the following detailed description of presently preferred embodiments of the invention taken in connection with the accompanying drawings.

BRIEF DESCRIPTION OF THE INVENTION

PRESENTLY PREFERRED EMBODIMENT

Figure 5:
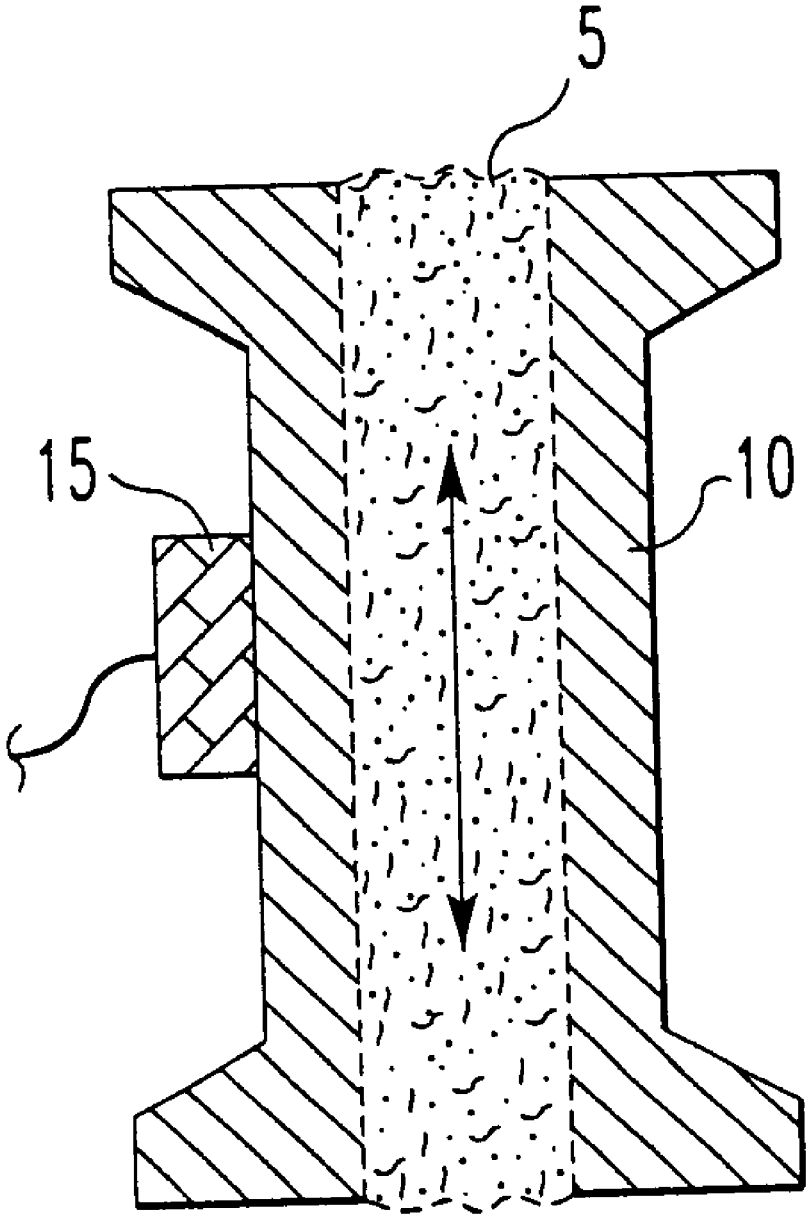
FIG. 5 PRIOR ART
FIG. 5 is prior art and is a schematic of a typical test stand used to monitor acoustic signals generated by abrasive media flowing through a bore in a workpiece.

The present invention is described in detail referring to work carried out in the prior art extraction of raw acoustic signals from the abrasive flow machining with an abrasive medium 5 of an aluminum intake manifold 10, illustrated in schematic in FIG. 5. The subject invention is directed to the unique processing of these signals. The data was acquired using an acoustic emission detector manufactured by Dunegan Engineering Consultants, Inc. called the AESMART 2000™. This equipment uses the SE9125-M or SE-900MWB sensors and two frequency filters. One filter is band-passed, at 20–60 kHz and the other is high-passed at 100 kMz. The transducers 15 are displacement sensitive in the low frequency range and velocity sensitive in the high frequency range. The transducers are also capable of detecting high frequency $S_h$ and $S_v$, shear waves. The AESMART instrument splits the signal from the transducer into two frequency bands; 20–60 kHz band-pass (LF), and 100 kHz high-pass (HF). Signals in each of these two frequency bands are analog peak detected and read by an A/D converter. The HF/LF ratio of the peak voltages is then calculated by the computer.

According to the present invention the HF/LF ratio is small at the beginning of the abrasive flow machining process because of the rough surface and removal of peaks, burrs and edges and increases upon further processing. The high frequency shear waves dominate the low frequency flexure waves as abrasive flow machining continues. This ratio is an effective indicator as to when to stop machining by controlling the flow.

In a process application to achieve optimum surface smoothness of the wall of a passage, the control of the flow of abrasive is initiated when the comparative ratio of the high frequency component and low frequency component approaches unity or the negative thereof.

When the objective of the process is to achieve a desired fluid flow specification for the passage, which specification is less than optimum surface smoothness, the control of the flow of abrasive is effected by a predetermined change of the ratio over time.

The HF/LF ratio and the, acoustic emission signals were acquired during the abrasive flow processing of an aluminum intake manifold. These tests were conducted with abrasive flow process conditions typical to those used in full-scale production. The main objectives of the tests were to: (1) correlate the acoustic emission signal (HF/LF ratio) and air flow changes in the manifold; and (2) determine the behavior of the high and low frequency components during processing and the acoustic emission.

Figure 1:
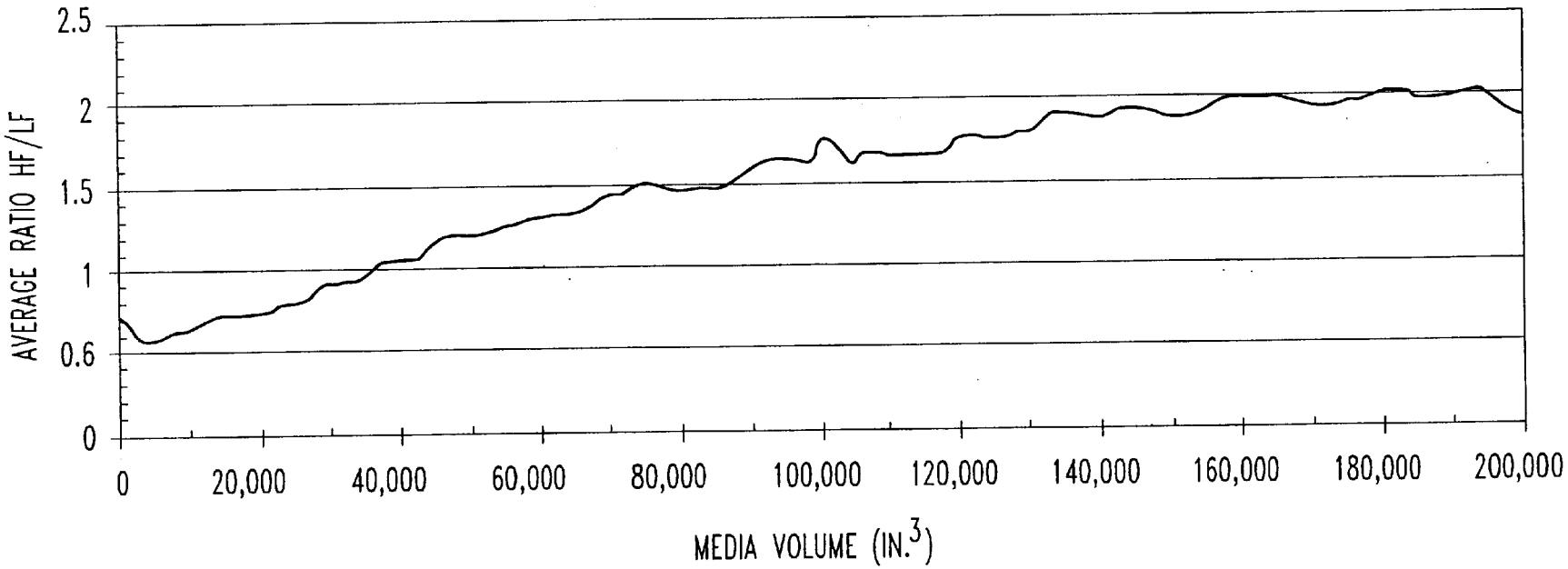
FIG. 1 is a graphical representation of the average ratio of high frequency to low frequency emission as a function of media volume.

A typical air flow profile of the intake manifold is established. This profile is developed by measuring the manifold on a flow bench, processing the part on an abrasive flow machine for a given number of cycles, and then cleaning the manifold and measuring the air flow again. FIG. 1 shows the average HF/LF ratio over time during abrasive flow machine processing. The ratio was lower at the start of the process and gradually increased as the amount of media flow volume increased. Eventually, the ratio stabilized and the slope of the curve was almost zero. Qualitatively, this HF/LF curve is very similar in shape to the air flow profile. A limited experiment (4 trials) was conducted on a test part to correlate exact changes in the HF/LF ratio and in air flow. The correlation coefficient, r, was a very high 0.99.

Figure 2:
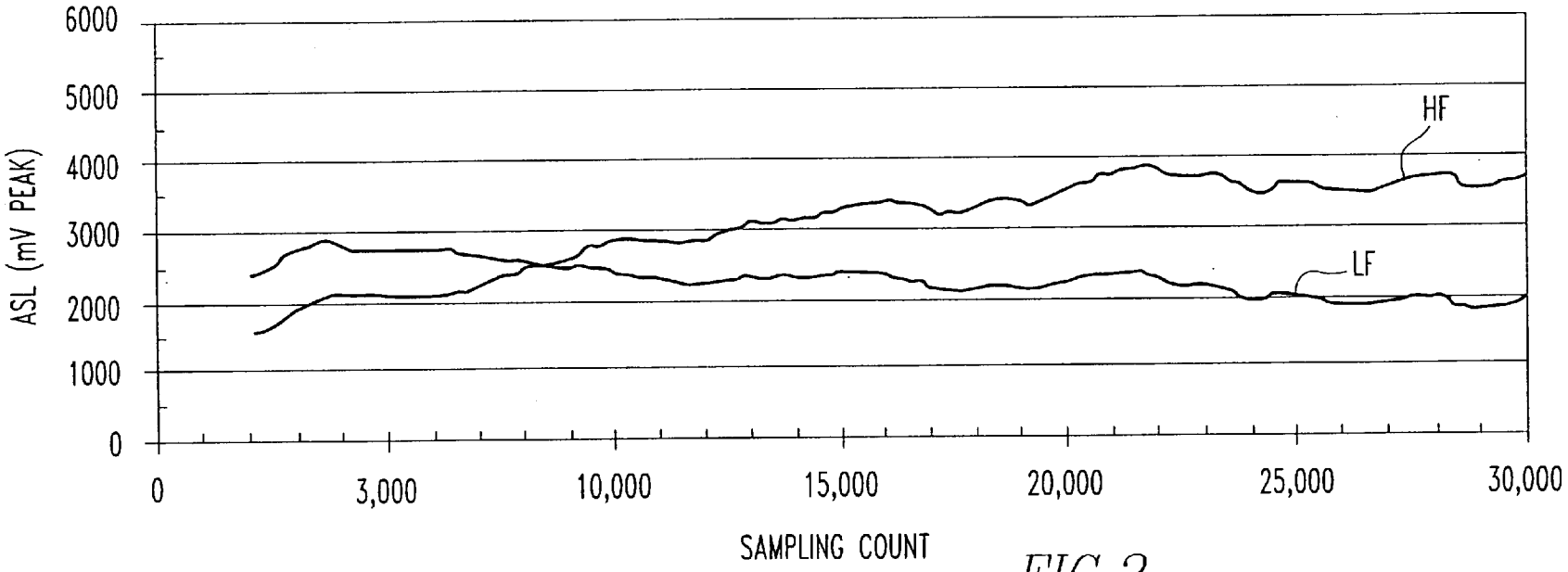
FIG. 2 is a graphical representation of the average sound level of the high and low frequency components.

FIG. 2 presents the high and low frequency components individually during the processing of a manifold. The low frequency portion is stronger at the start of the abrasive flow machine process, slightly decreases and then levels off. The high frequency portion rises sharply at the start of the process and then dominates the acoustic emission signal.

Figure 3:
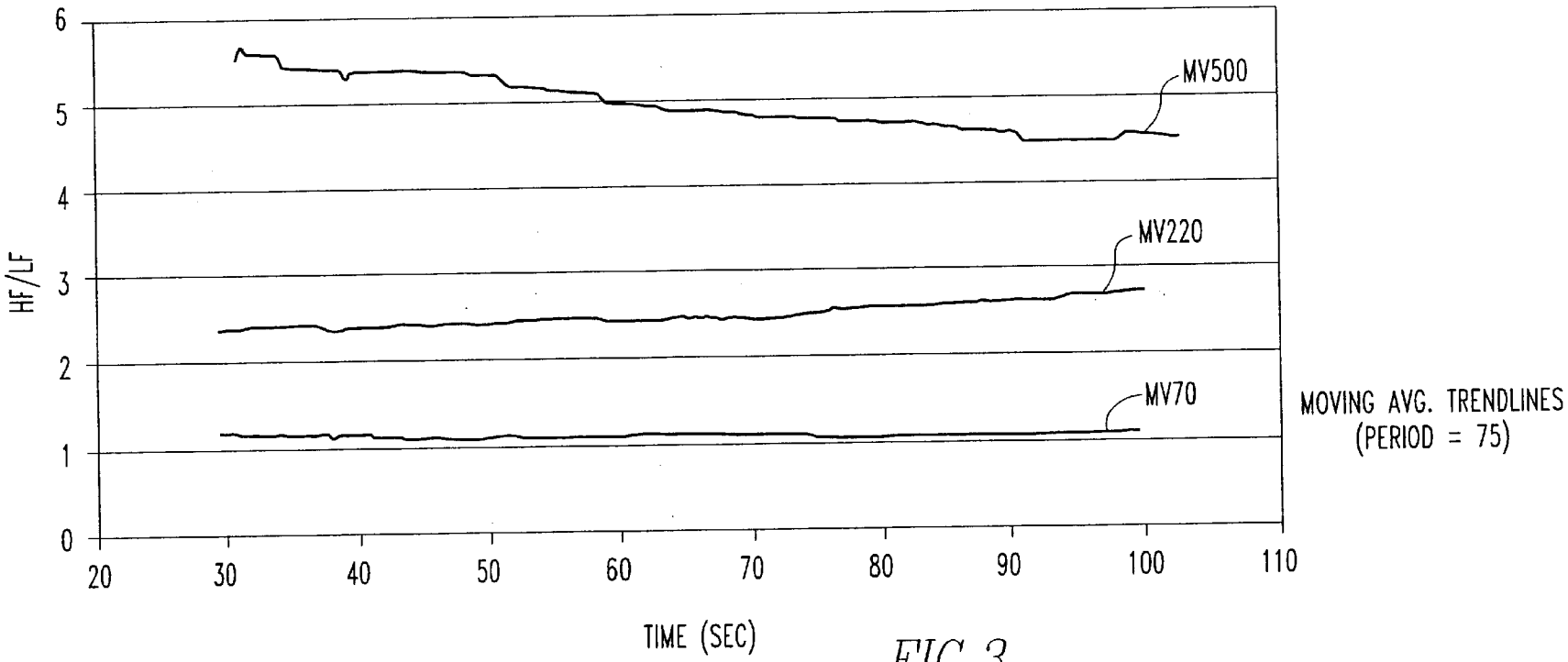
FIG. 3 is a graphical representation of the ratio as a function of time for various grit sizes in the media.

The amount of material removal in abrasive flow machine is determined by several factors including workpiece material, media viscosity, extrusion pressure, and the type and size of the abrasive grains. FIG. 3 shows the results of tests conducted with constant viscosity media (MV) and various sizes of silicon carbide abrasives. These trends strongly agree with our earlier theories about the HF/LF ratio for abrasive flow machining. The HF/LF ratio was much higher for the smaller, 500 grit size abrasives. Larger abrasive flow machining grains (eg. 70 grit) would remove more material, causing the LF component to dominate.

This would mean a lower HF/LF ratio as found in FIG. 3. This effect was the same in tests with both steel and aluminum workpieces. The long term trends in the HF/LF ratio would not be seen in the very short timeframe (100 seconds) of the test.

Figure 4:
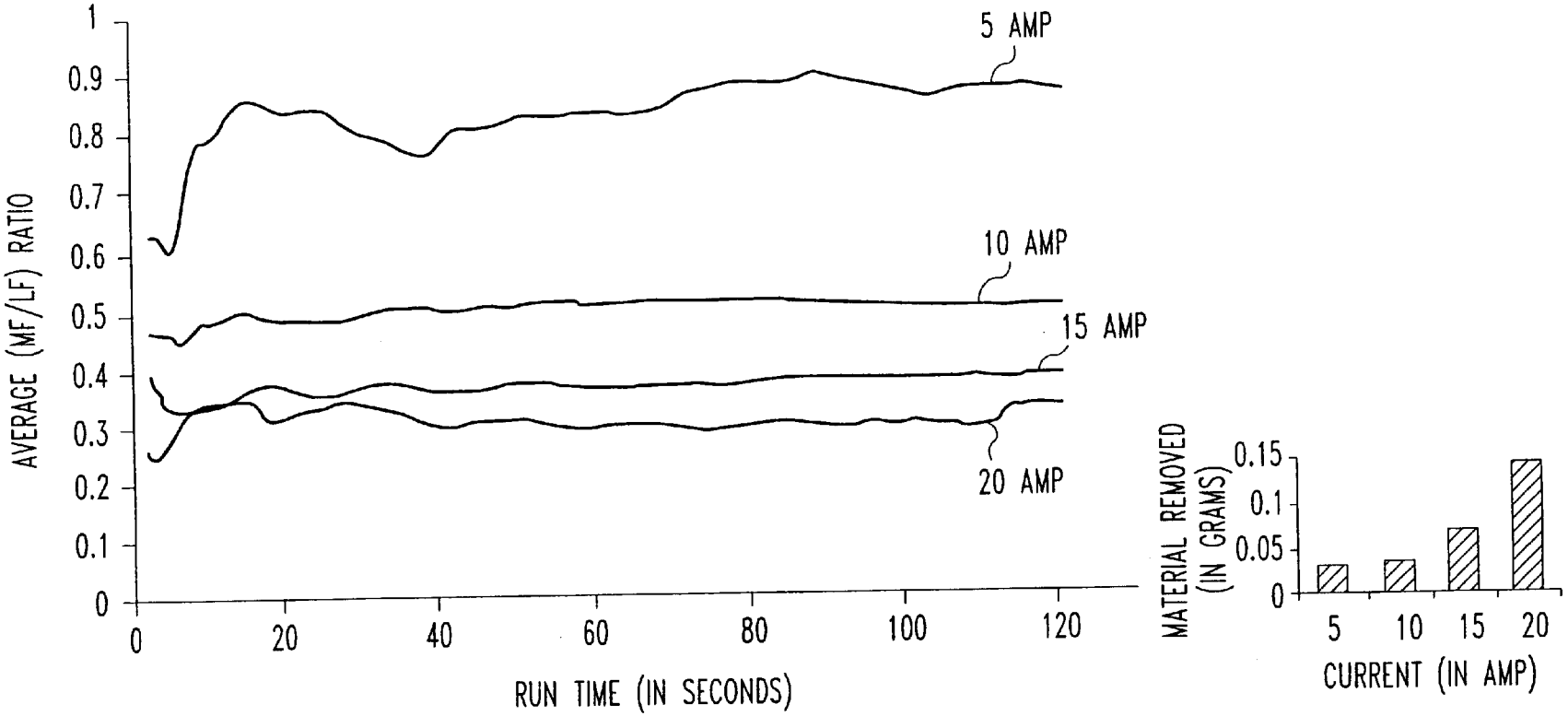
FIG. 4 is a graphical representation of the average ratio as a function of runtime for varying electrical currents in abrasive electrodischarge grinding.

Another set of tests were conducted using abrasive electrodischarge grinding (rotary EDM) in which a controlled electrodischarge process is assisted by mechanical grinding. The mechanical grinding and electrodischarge erosion can be controlled by adjusting the grinding wheel feed rates and electrical pulse parameters. FIG. 4 shows that the method of the present invention is useful electrodischarge grinding. The average HF/LF ratio correlates with the run time for various current levels. In this case, a higher current produces greater material removal and a corresponding lower average HF/LF ratio. The LF components of the acoustic emission signal dominates because of the generation of low frequency flexure waves and mode converted shear waves. Thus, a negative correlation.

While presently preferred embodiments of the invention have been shown and described in particularity the invention may be otherwise embodied within the scope of the appended claims.

What is claimed is:

1. A method for controlling the abrasive machining of a part comprising:

a. measuring any acoustic emission signal caused by the abrasive machining of said part;

b. comparing a high frequency component of said signal with a low frequency component of said signal; and c. controlling said machining based upon a predetermined ratio of said components.

2. The method as set forth in claim 1 wherein said low frequency component is less than 100 kHz and said high frequency component is greater than 100 kHz.

3. The method as set forth in claim 1 wherein said low frequency component is selected from about 20 to 60 kHz and said high frequency is greater than about 100 kHz.

4. The method as set forth in claim 1 wherein said abrasive machining comprises abrasive flow machining.

5. The method as set forth in claim 1 wherein the step of controlling said machining is comprised of terminating the machining.

6. The method as set forth in claim 1 wherein the abrasive machining is abrasive flow machining and the step of controlling said machining is comprised of providing a particular media flow rate for the abrasive flow machining.

7. A method for controlling the abrasive machining processing of a part comprising:

a. measuring an acoustic emission signal caused by the abrasive machining of said part;

b. comparing a high frequency component of said signal with a low frequency component of said signal; and c. controlling said machining based upon a predetermined change of the ratio of said component over time.

8. The method as set forth in claim 7 wherein the step of controlling said machining is comprised of terminating the machining.

9. The method as set forth in claim 7 wherein the abrasive machining is abrasive flow machining and the step of controlling said machining is comprised of providing a particular media flow rate for the abrasive flow machining.

10. A method for controlling the abrasive machining of a part comprising:

a. measuring an acoustic emission signal caused by the abrasive machining of said part;

b. dividing said signal into various band-pass frequency components; developing arithmetic combinations of said frequency components; and c. controlling said machining by selecting a control action based upon the behavior during time of said arithmetic combinations.

11. The method as set forth in claim 10 wherein the step of controlling said machining is comprised of terminating the machining.

12. The method as set forth in claim 10 wherein the abrasive machining is abrasive flow machining and the step of controlling said machining is comprised of providing a particular media flow rate for the abrasive flow machining.

13. The method as set forth in claims 1, 7 or 10 wherein said high frequency component correlates to media flow rate and said low frequency component correlates to material removal.

* * * * *

UNITED STATES PATENT AND TRADEMARK OFFICE

CERTIFICATE OF CORRECTION

PATENT NO. : 6,319,094 B1
DATED : November 20, 2001
INVENTOR(S) : Robert E. Williams It is certified that error appears in the above-identified patent and that said Letters Patent is hereby corrected as shown below:

Title page,
Item [73] Assignee, "Home" should read -- Hone --.

Column 1,
After the Title and before FIELD OF THE INVENTION, insert the following new heading and paragraph:
-- STATEMENT REGARDING FEDERALLY SPONSORED RESEARCH OR DEVELOPMENT The United States Government has rights in this invention pursuant to United States Department of Commerce National Institute of Standards and Technology's Advanced Technology Program Award No. 70NANB5H1144. --

Column 1,
Line 6, "relates a method" should read -- relates to a method --.
Line 65, "the desires" should read -- the desired --.

Column 2,
Line 34, "effect" should read -- affect --.
Line 46, "provide method" should read -- provide a method --.
Line 61, "applications;" should read --applications, --.

Column 3,
Line 34, "result the" should read -- result in the --.

UNITED STATES PATENT AND TRADEMARK OFFICE

CERTIFICATE OF CORRECTION

PATENT NO. : 6,319,094 B1
DATED : November 20, 2001
INVENTOR(S) : Robert E. Williams It is certified that error appears in the above-identified patent and that said Letters Patent is hereby corrected as shown below:

Column 4,
Line 54, "the, acoustic" should read -- the acoustic --.

Signed and Sealed this

Twenty-first Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,319,094 B1
APPLICATION NO. : 09/474237
DATED : November 20, 2001
INVENTOR(S) : Robert E. Williams It is certified that error appears in the above-identified patent and that said Letters Patent is hereby corrected as shown below:

Column 1 at line 11 insert the following phrase, --This invention was made with government support under grants DMI9701941 and DDM9102937 awarded by the United States National Science Foundation. The government has certain rights in the invention.--

Signed and Sealed this

Nineteenth Day of February, 2008

JON W. DUDAS
*Director of the United States Patent and Trademark Office*